US009297595B2

(12) United States Patent
Said et al.

(10) Patent No.: US 9,297,595 B2
(45) Date of Patent: Mar. 29, 2016

(54) HEAT EXCHANGER FLOW BALANCING SYSTEM

(71) Applicant: KING FAHD UNIVERSITY OF PETROLEUM AND MINERALS, Dhahran (SA)

(72) Inventors: Syed A. M. Said, Dhahran (SA); Rached Ben Mansour, Dhahran (SA); Mohamed A. Habib, Dhahran (SA); Muhammad Umar Siddiqui, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 205 days.

(21) Appl. No.: 13/973,961

(22) Filed: Aug. 22, 2013

(65) Prior Publication Data

US 2015/0053385 A1 Feb. 26, 2015

(51) Int. Cl.

| | |
|---|---|
| ***F28F 9/02*** | (2006.01) |
| ***G05D 23/00*** | (2006.01) |
| ***F28D 1/053*** | (2006.01) |

(52) U.S. Cl.

CPC ..... *F28F 9/0282* (2013.01); *F28D 1/05325* (2013.01)

(58) Field of Classification Search

CPC ..... F28F 1/006; F28F 9/026; F28F 9/0282; F28F 9/028; F28D 1/04; F28D 1/053; F28D 1/05316; F28D 1/05325

USPC ..... 165/174, 159, 160, 281, 283, 284

See application file for complete search history.

(56) References Cited

U.S. PATENT DOCUMENTS

| | | | | |
|---|---|---|---|---|
| 1,748,121 | A * | 2/1930 | Gay | 165/115 |
| 3,196,943 | A | 7/1965 | Haerter | |
| 3,229,761 | A * | 1/1966 | Ware | 165/142 |
| 3,516,483 | A * | 6/1970 | Benteler et al. | 165/218 |
| 4,093,024 | A * | 6/1978 | Middleton | 165/170 |
| 4,458,750 | A | 7/1984 | Huber | |
| 4,607,689 | A * | 8/1986 | Mochida et al. | 165/110 |
| 5,542,271 | A * | 8/1996 | Kudoh | F25B 39/00 165/146 |
| 5,901,785 | A | 5/1999 | Chiba et al. | |
| 5,934,367 | A * | 8/1999 | Shimmura et al. | 165/174 |
| 6,714,413 | B1 * | 3/2004 | Ghosh | F28D 15/0266 165/104.21 |
| 7,527,089 | B2 * | 5/2009 | Gorbounov et al. | 165/174 |
| 2003/0210525 | A1 * | 11/2003 | Chung | H01L 23/3672 361/695 |

(Continued)

FOREIGN PATENT DOCUMENTS

| | | |
|---|---|---|
| DE | 2209684 | 9/1973 |
| GB | 2250336 | 6/1992 |

*Primary Examiner* — Allen Flanigan
*Assistant Examiner* — Jason Thompson
(74) *Attorney, Agent, or Firm* — Richard C. Litman

(57) ABSTRACT

The heat exchanger flow balancing system serves to substantially equalize fluid flow through essentially identical diameter heat exchanger tubes in a heat exchanger having a single inlet plenum, a single outlet plenum, and a series of equal diameter heat exchanger tubes extending therebetween. In one embodiment, a series of different diameter orifices are provided at the inlet end of each of the tubes, with those tubes farther from the single larger diameter inlet pipe to the plenum generally having smaller orifices. In another embodiment, each of the tubes is provided with a conical nozzle at its inlet end, with those tubes farther from the single inlet pipe to the plenum generally having smaller diameter nozzles. The effect is to substantially equalize fluid flow through all of the heat exchanger tubes, thus increasing the efficiency of the heat exchanger.

16 Claims, 9 Drawing Sheets

(56) References Cited

U.S. PATENT DOCUMENTS

2009/0229805 A1 9/2009 Beamer et al.
2011/0061845 A1 3/2011 Wand
2012/0292004 A1 11/2012 Chen et al.
2012/0318473 A1* 12/2012 Nishikawa et al. ..... 165/41

* cited by examiner

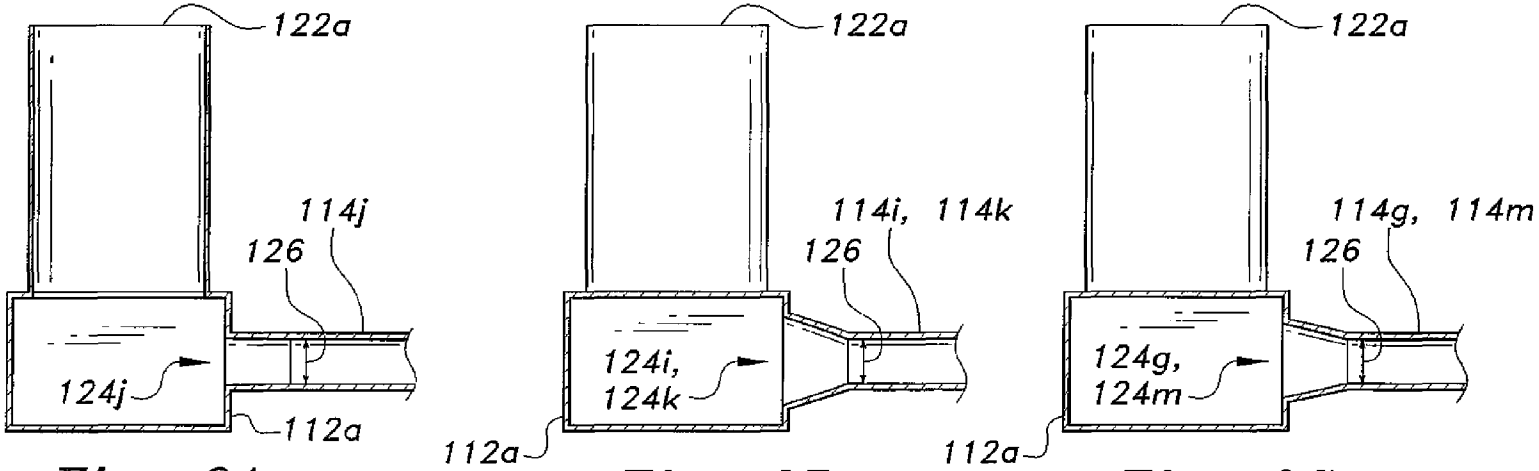
Fig. 6A
Fig. 6B
Fig. 6C
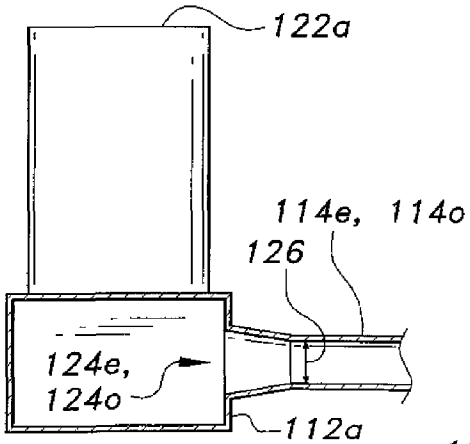
Fig. 6D
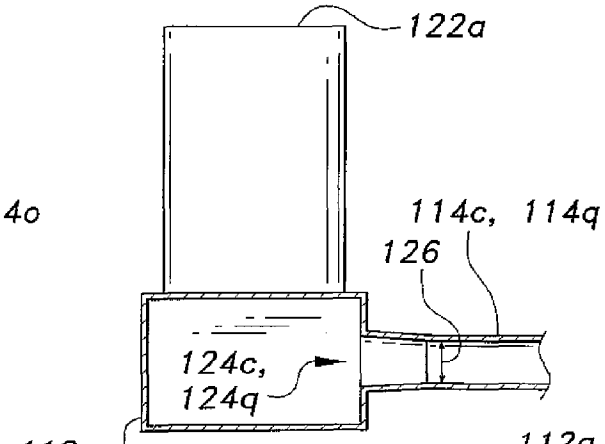
Fig. 6E
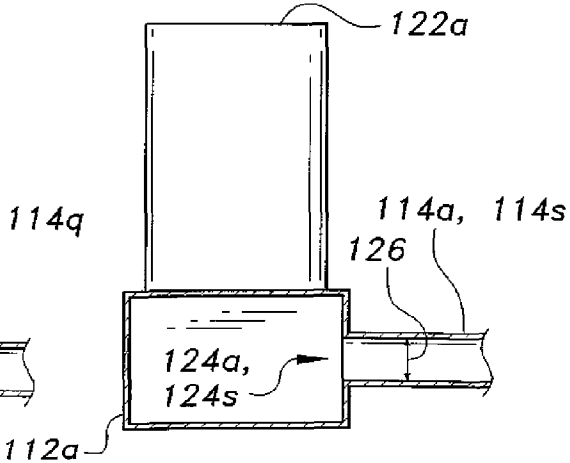
Fig. 6F

HEAT EXCHANGER FLOW BALANCING SYSTEM

BACKGROUND OF THE INVENTION

1. Field of the Invention

The present invention relates to devices for handling pneumatic flow, and particularly to a heat exchanger flow balancing system incorporating means for controlling the pneumatic flow through each of the multiple tubes of a heat exchanger in order to create substantially equal flow through each tube.

2. Description of the Related Art

Heat exchangers, also known as radiators in many applications, are used in a wide variety of applications including stationary and vehicle heating and air conditioning systems, engine supercharging and turbocharging intercooler systems, power generation, and other mechanical and pneumatic systems of various types. The heat exchangers manufactured for these systems are generally relatively simply constructed, with their heat exchanging tubes all being cut from the same stock material to have the same diameters and wall thicknesses. Generally, a single header or entry plenum is provided, with this plenum having a single relatively large diameter inlet with a relatively large number of equal diameter heat exchanger tubes extending to an outlet plenum with its single large diameter outlet or exhaust tube. The inlet and outlet tubes may connect to their respective plenums at either end of the plenum or at some point at or near the center of the plenum, or perhaps at some other location on the plenum depending upon manufacturing considerations, physical constraints for the intended installation, and perhaps other factors.

The problem with such equal tube diameter heat exchangers is that the fluid flow varies to each of the individual tubes, depending upon the distance of the tube inlet from the larger single intake tube of the plenum (and perhaps other factors as well, such as any changes in direction of airflow from the inlet tube to the individual heat exchanger tubes). Much the same problem can occur at the outlet plenum as well. This can result in significant variation in the fluid flow through the heat exchanger tubes located at some distance from the large intake tube, in comparison to those heat exchanger tubes having their inlets adjacent to the inflow from the single large intake tube. The result is that the heat exchanger is far less efficient than it might otherwise be, if the fluid flow were at least close to equal through each of the individual heat exchanger tubes.

Innumerable heat exchanger and radiator configurations have been developed in the past, as noted further above. An example of such is found in German Patent Publication No. 2,209,684 published on Sep. 13, 1973 to Karl Heinkel Apparatebau KG. This reference describes a heat exchanger having a two-way flow path contained within a single plenum, with the two flow directions separated by an internal wall. A series of tubes extend from the inlet side of the plenum, with these tubes contained concentrically within larger diameter tubes. Fluid flowing into the inlet side and through the smaller diameter tubes leaves the smaller tubes at their open distal ends, flowing into the surrounding larger diameter tubes and returning to the outlet side of the plenum.

Thus, a heat exchanger flow balancing system addressing the aforementioned problems is desired.

SUMMARY OF THE INVENTION

The heat exchanger flow balancing system is adapted for use in heat exchangers constructed with tubes of equal diameter extending between the inlet and outlet plenums, where the inlet and/or outlet plenum(s) do not distribute the fluid flow equally to all of the tubes. The flow balancing system serves to substantially equalize fluid flow through all of the tubes, thus substantially equalizing heat exchange between the tubes to increase the efficiency of the device.

Two examples of embodiments are provided and described, but should not be construed in a limiting sense. A first embodiment of a heat exchanger flow balancing system restricts the diameter of the inlet opening to various tubes, with the inlet opening being smaller for those tubes located farther from the single inlet tube or pipe of the plenum to substantially balance the flow in the tubes. A second embodiment of a heat exchanger flow balancing system accomplishes the flow equalization by means of a series of conical inlets, or nozzles, between each of the heat exchanger tubes and the plenum, with the inlet or nozzle opening being smaller for those tubes located farther from the single inlet tube or pipe of the plenum to substantially balance the flow in the tubes.

While the drawings depict heat exchangers having an intake plenum with a single large diameter delivery tube located substantially at the center of the plenum and with its axis normal to the axes of the smaller heat exchanger tubes, it will be seen that the heat exchanger flow balancing system may be configured for heat exchangers having their inlet or delivery tubes located in other positions relative to the plenum, e.g., at one end thereof, etc. The heat exchanger flow balancing system may be configured for installation at the outlet ends of the heat exchanger tubes, as well.

These and other features of the present invention will become readily apparent upon further review of the following specification and drawings.

BRIEF DESCRIPTION OF THE DRAWINGS

FIGS. 6A through 6F are a series of elevation views in section through six of the tubes of the heat exchanger of FIGS. 4 and 5, illustrating the different conical restrictions incorporated with each to equalize the pneumatic flow through the tubes.

Unless otherwise indicated, similar reference characters denote corresponding features consistently throughout the attached drawings.

DETAILED DESCRIPTION OF THE PREFERRED EMBODIMENTS

The heat exchanger flow balancing system includes, for example, various embodiments, each providing for the equalization or substantial equalization of flow through the various tubes of the heat exchanger. The equalizing of the flow through the tubes results in relatively greater efficiency of the heat exchanger, as all of the tubes have substantially equal flow and thus substantially equal heat transfer with the surrounding environment.

Figure 1:
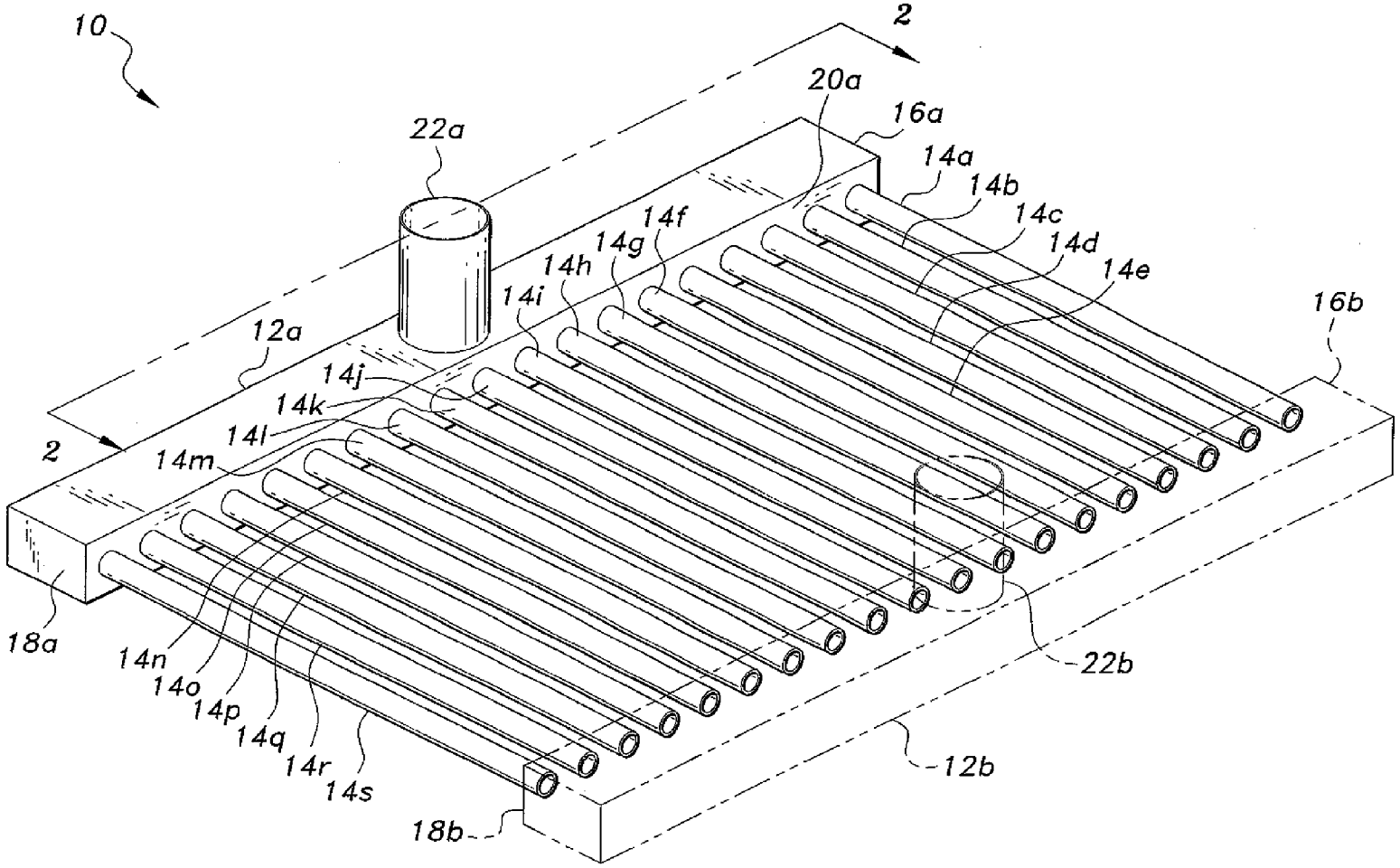
FIG. 1 is a partial perspective view of a heat exchanger incorporating a first embodiment of the heat exchanger flow balancing system according to the present invention.

FIGS. 1 through 3F illustrate a first embodiment of a heat exchanger flow balancing system, with FIG. 1 illustrating a heat exchanger 10 incorporating the first embodiment. The heat exchanger 10 has a first plenum or header 12*a* and an opposite second plenum or header 12*b* (shown in broken lines) with a plurality of substantially equal diameter heat exchanger tubes 14*a* through 14*s* extending therebetween. It will be understood that the nineteen heat exchanger tubes 14*a* through 14*s* are exemplary, and that more or fewer such tubes may be provided. Each of the two plenums 12*a* and 12*b* has a first end, respectively 16*a* and 16*b*, an opposite second end, respectively 18*a* and 18*b*, and a tube wall, respectively 20*a* and 20*b*, with the series of heat exchanger tubes 14*a* through 14*s* extending between the two tube walls 20*a* and 20*b*. A first transfer pipe 22*a* extends generally medially from the first plenum 12*a*, and a second transfer pipe 22*b* extends generally medially from the second plenum 12*b*. Fluid flow through the heat exchanger 10 may be in either direction, with the first transfer pipe 22*a* and plenum 12*a* serving as an inlet pipe and plenum, or as the outlet pipe and plenum, depending upon the connection of the heat exchanger 10 to the remainder of the heat exchanger system.

Figure 2:
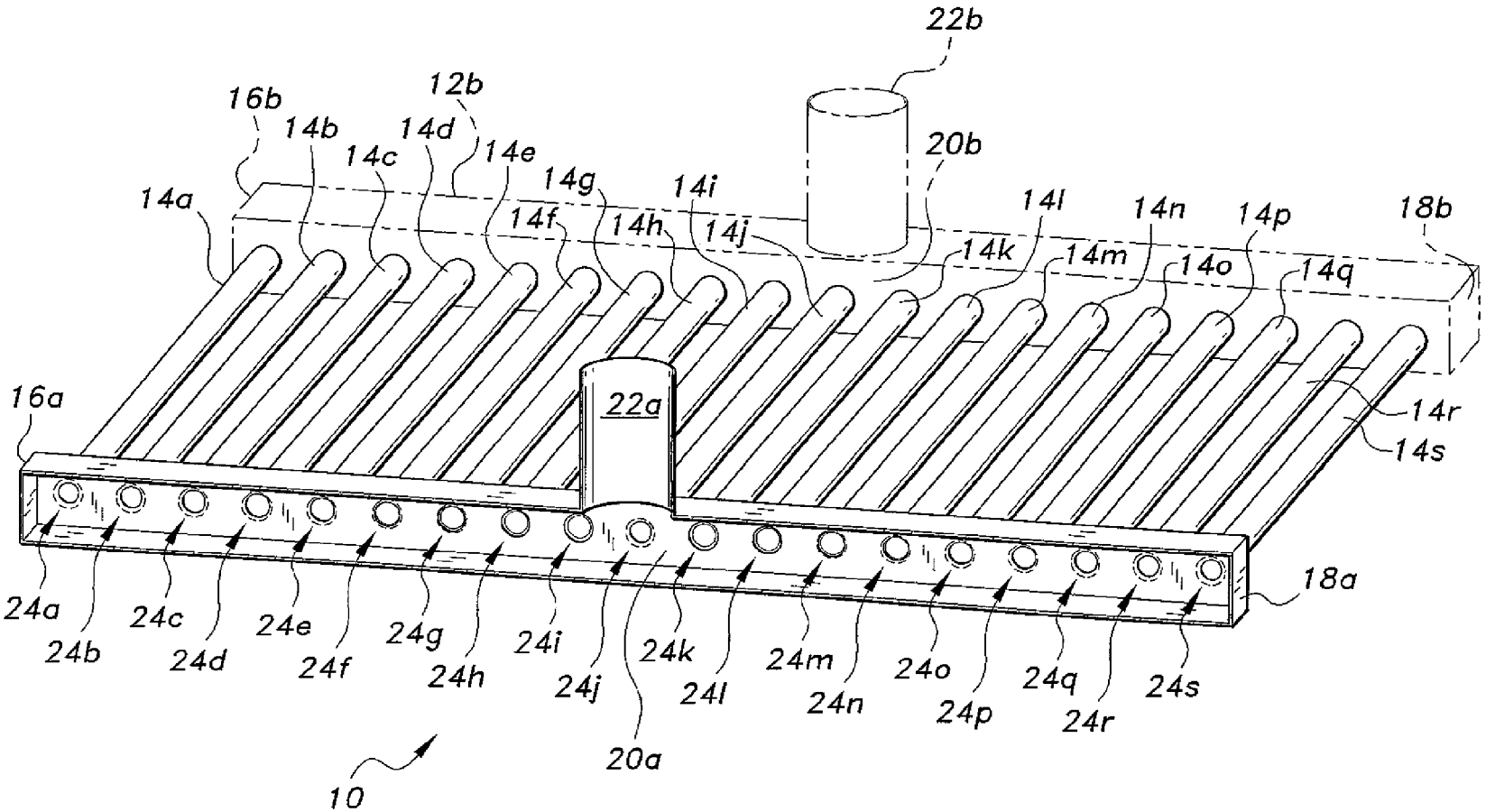
FIG. 2 is a perspective view in section along line 2-2 of the heat exchanger incorporating the heat exchanger flow balancing system of FIG. 1, illustrating further details thereof.

In FIG. 2, the interior of the tube wall 20*a* of the first plenum 12*a* is shown clearly in the perspective view in section along line 2-2 of FIG. 1, with the heat exchanger tubes 14*a* through 14*s* extending therefrom to the opposite second plenum 12*b*. The junctures of the ends of the substantially equal diameter tubes 14*a* through 14*s* are shown in broken line circles of equal diameter along the tube wall 20*a* of the first plenum 12*a* in FIG. 2. However, a series of flow restriction orifices 24*a* through 24*s* of varying diameters are shown within the broken line circles designating the tube ends. FIGS. 3A through 3F provide cross-sectional elevation views through various tubes and their flow restriction orifices, to illustrate concepts of the heat exchanger 10. The orifices 24*a* through 24*s* may be integral with the tube wall 20*a* of the plenum 12*a*, e.g., formed by punching or otherwise forming holes or passages through the tube wall 20*a*, or alternatively by welding or otherwise adding a disc of material across larger passages formed for each of the heat exchanger tubes, or across the ends of the tubes, with the discs having calibrated flow restriction orifices formed therethrough.

Figure 3B:
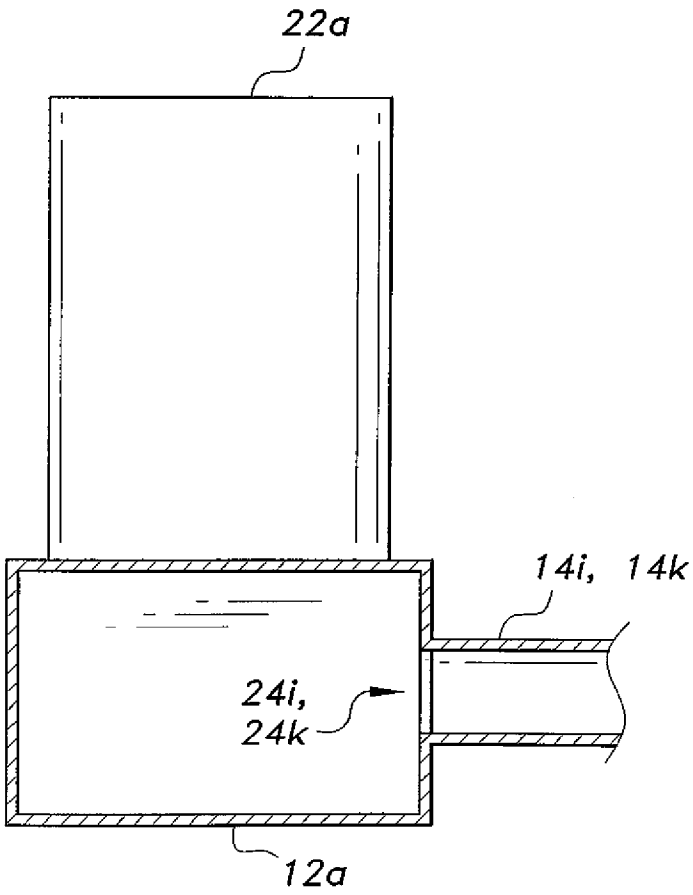
FIGS. 3A through 3F are a series of elevation views in section through six of the tubes of the heat exchanger of FIGS. 1 and 2, illustrating the different diameter restrictions incorporated with each to equalize the pneumatic flow through the tubes.
Figure 3A:
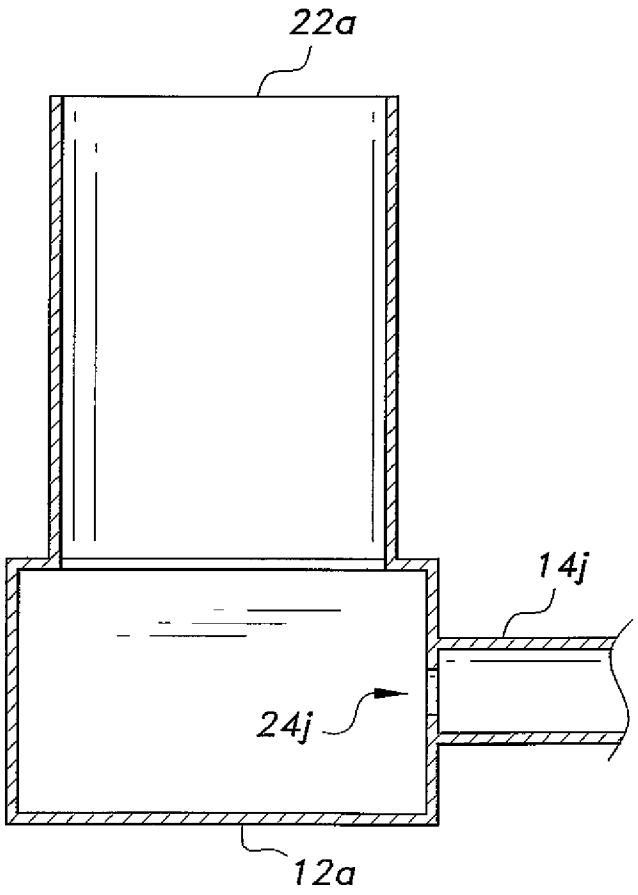
Figure 3D:
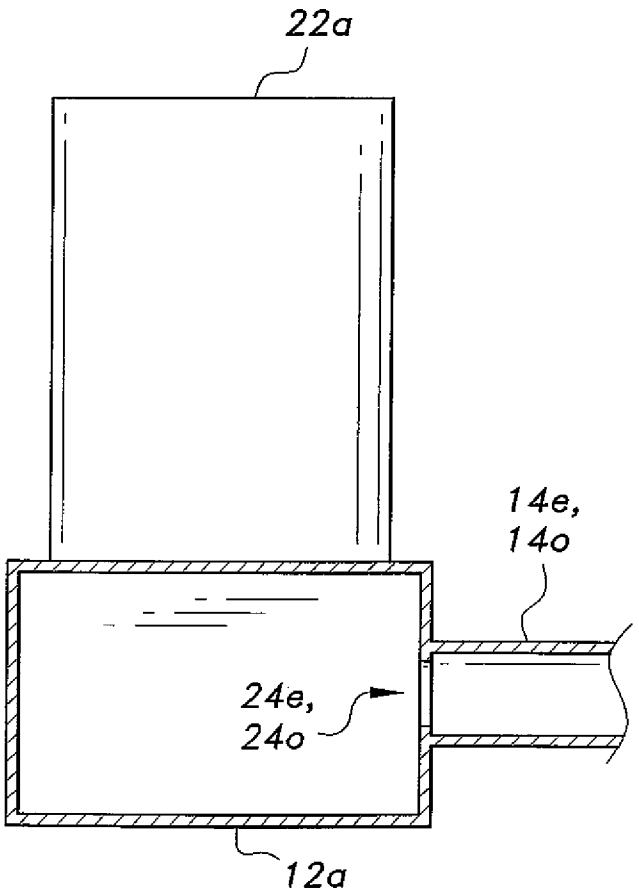
Figure 3C:
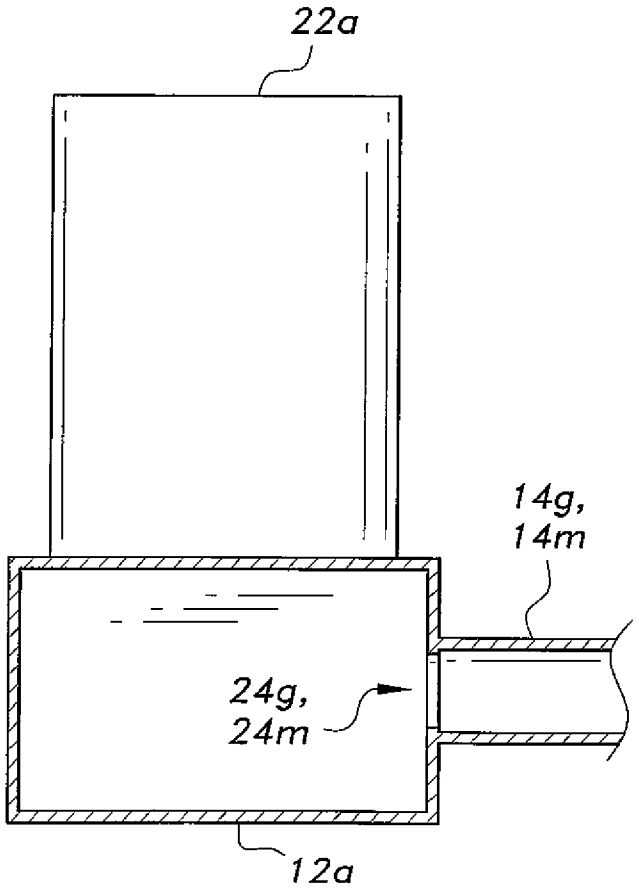
Figure 3F:
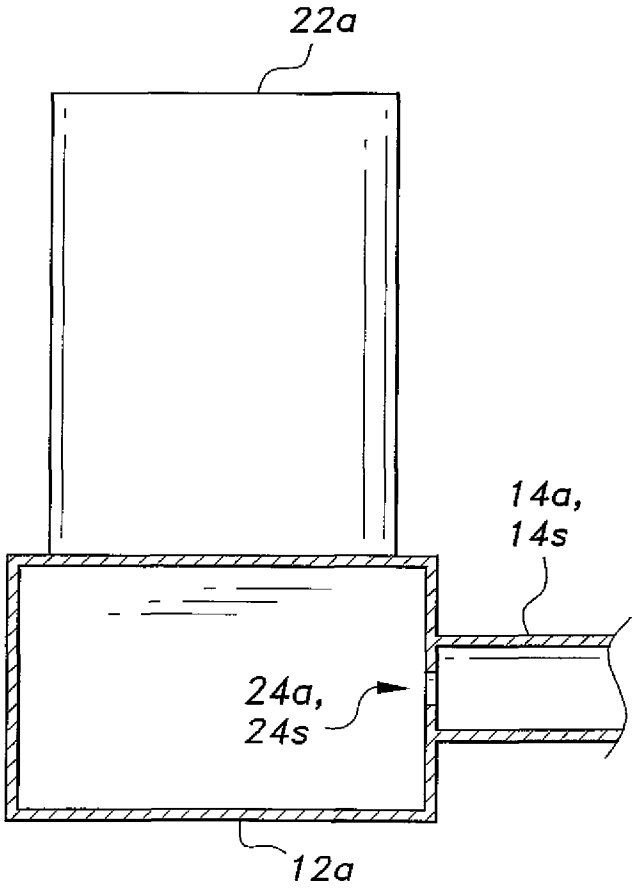

The orifices 24*a* through 24*s* vary in diameter from smallest orifices 24*a* and 24*s* at the extreme ends 16*a* and 18*a* of the plenum 12*a*, generally as shown in FIG. 3F, to largest orifices 24*i* and 24*k* immediately to the sides of the central transfer pipe 22*a*, generally as shown in FIG. 3B. This is because fluid flowing into or out of the plenum 12*a* through the transfer pipe 22*a* will generally have a relatively large radial velocity component relative to the tubes as it flows along the length or span of the plenum 12*a*, i.e., the fluid will tend to flow across the openings to the tubes rather than directly into the tubes. The exception is of course at the ends of the plenum, where the fluid is constrained by the plenum ends 16*a* and 18*a*. The corresponding tubes 14*a* and 14*s* would thus allow significantly greater flow than the tubes further inboard. Accordingly, the smallest diameter flow restriction orifices 24*a* and 24*s* are provided for tubes 14*a* and 14*s* to substantially equalize their flow relative to other tubes of the heat exchanger 10.

The greatest radial velocity component is typically generated closest to the center of the plenum 12*a*, close to the transfer pipe 22*a*. Accordingly, the largest diameter orifices 24*i* and 24*k* are located at the entrances to the corresponding tubes 14*i* and 14*k*, generally as shown in the cross-sectional view of FIG. 3B. However, it will be seen that the tube 14*j* located between the two tubes 14*i* and 14*k*, has its opening essentially concentric with the center of the transfer pipe 22*a*. The fluid at this location essentially "splits" to flow in opposite directions through the length of the plenum 12*a*, with little radial velocity component directly along the center of the transfer pipe 22*a*. Thus, the central tube 14*j* will have relatively high flow and a correspondingly small orifice 24*j* is installed at the opening thereto, generally as shown in FIG. 3A. The orifice 24*j* may be about the same diameter as the two extreme end orifices 24*a* and 24*s*, or perhaps only slightly larger, depending upon the measured or calculated flow, for example.

Figure 3E:
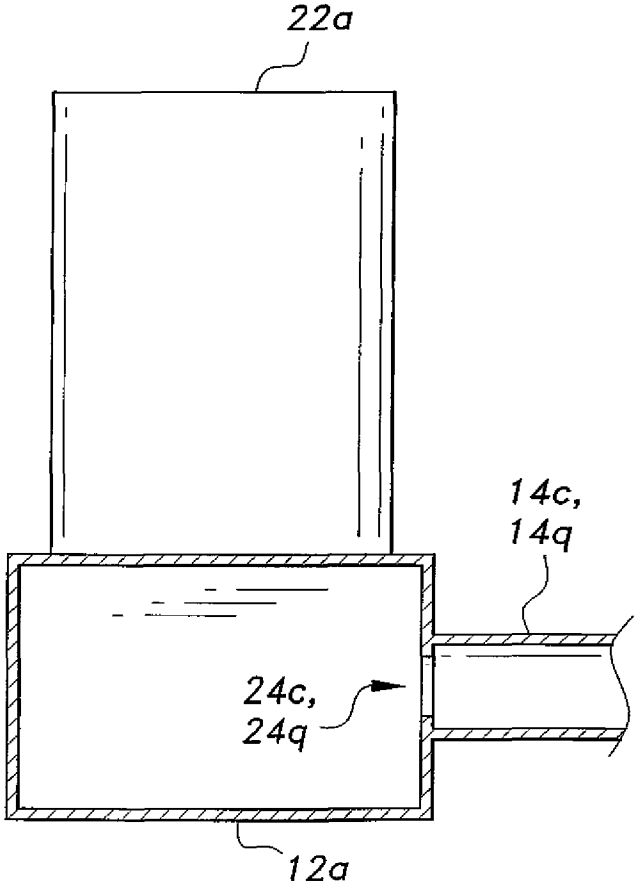

The other orifices have intermediate diameters between the relatively smallest diameters of the two end orifices 24*a* and 24*s* and the relatively largest diameters of the two orifices 24*i* and 24*k*, with the diameters changing incrementally, or changing based on the radial velocity at the corresponding orifice, between smallest and largest orifices, to substantially balance the flow in the tubes. Thus, typically the diameter of the orifice 24*b* is larger than the diameter of the orifice 24*a*, the orifice 24*c* is slightly larger in diameter than the diameter of the orifice 24*b*, etc., with the diameter of the orifice 24*i* being slightly larger than the diameter of the orifice 24*h* and the orifice 24*i* having a diameter substantially equal to the inner diameter of the tube 14*i*, and the diameter of the tube 14*i* being substantially equal to the diameter of the other tubes 14*a* through 14*s*, for that matter. Similarly, the orifices 24*l* to 24*r* gradually decrease in diameter between the relatively largest diameter of the orifice 24*k* and the relatively smallest diameter of the orifice 24*s*. For example, FIG. 3C illustrates an intermediate orifice 24*g* or 24*m* for tube 14*g* or 14*m*, FIG. 3D illustrates a somewhat smaller diameter intermediate orifice 24*e* or 24*o* for the corresponding tubes 14*e* or 14*o*, and FIG. 3E illustrates an even smaller diameter intermediate orifice 24*c* or 24*q* for corresponding tubes 14*c* or 14*q*. Other orifices not shown in FIGS. 3A-3F have diameters that fall between those depicted in FIGS. 3A through 3F in a relative order, for example.

Figure 4:
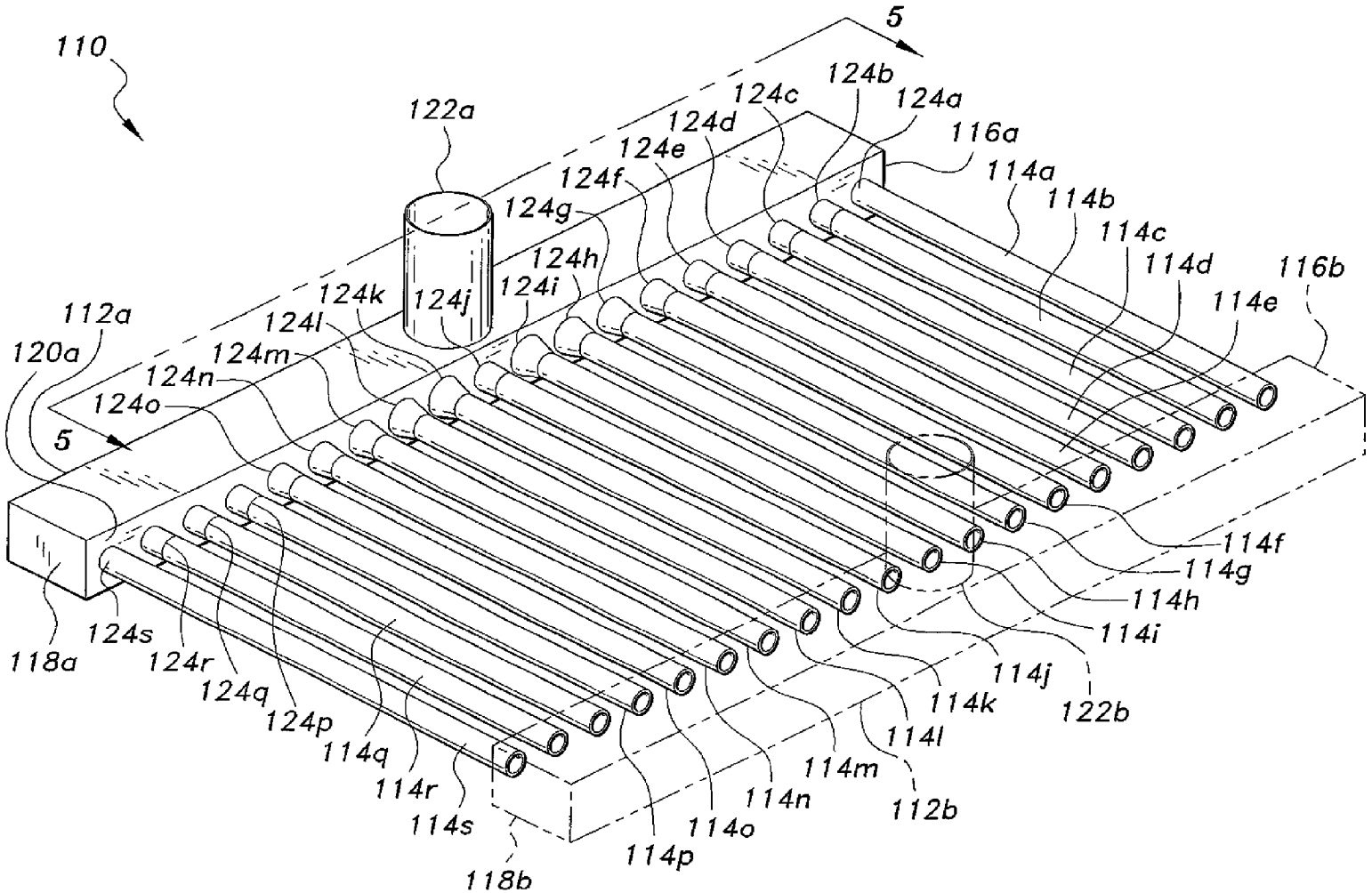
FIG. 4 is a partial perspective view of a heat exchanger incorporating a second embodiment of the heat exchanger flow balancing system according to the present invention.
Figure 5:
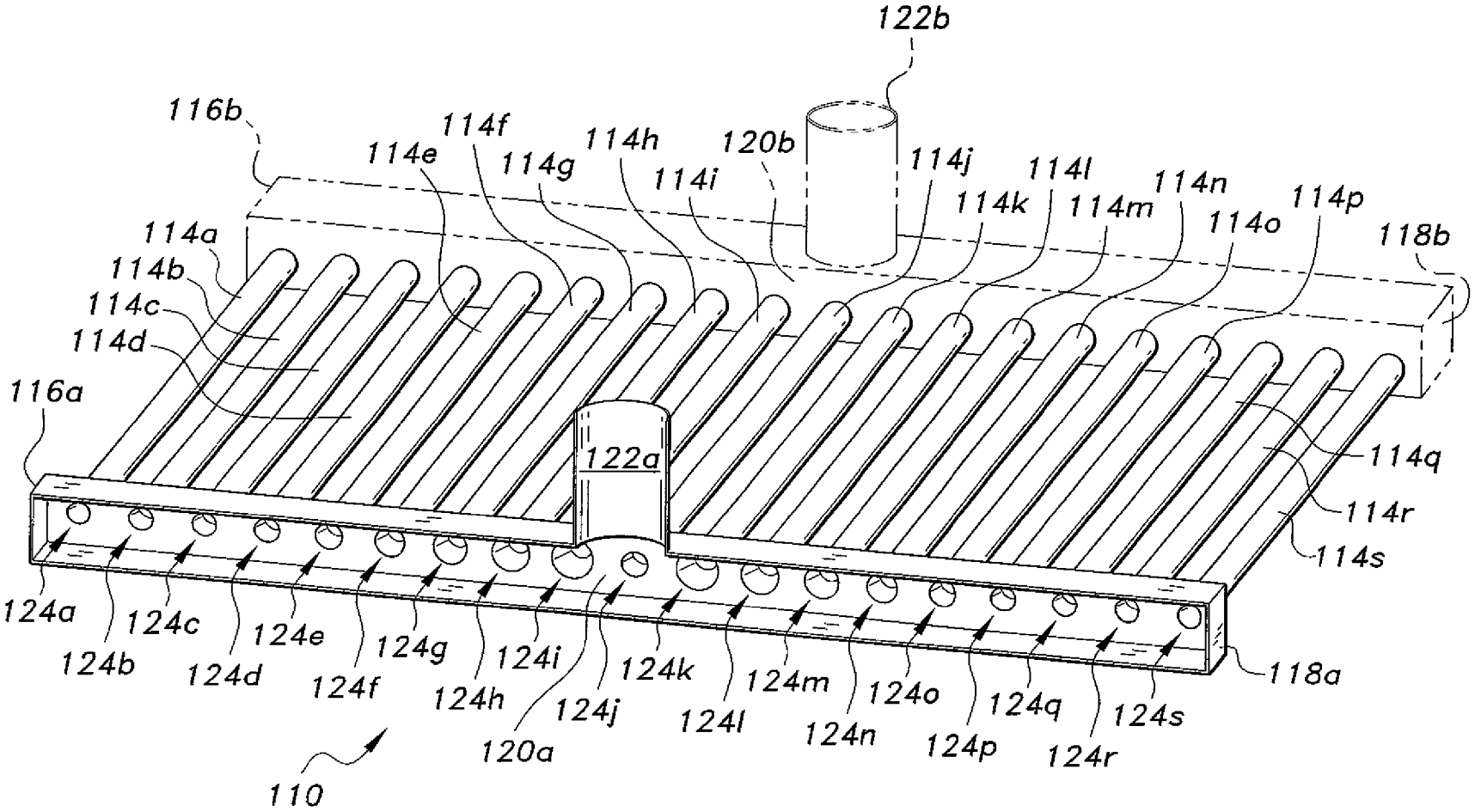
FIG. 5 is a perspective view in section along line 5-5 of the heat exchanger incorporating the heat exchanger flow balancing system of FIG. 4, illustrating further details thereof.

FIGS. 4 through 6F provide illustrations of a second embodiment of a heat exchanger flow balancing system. FIGS. 4 and 5 illustrate a heat exchanger 110. The heat exchanger 110 includes first and second plenums 112*a* and 112*b*, with the plenums having first and second ends and tube walls 116*a*, 118*a*, and 120*a* for the first plenum 112*a* and 116*b*, 118*b*, and 120*b* for the second plenum 112*b*. First and second transfer pipes, respectively 122*a* and 122*b*, extend from the medial areas of the two corresponding plenums 112*a* and 112*b*. A plurality of heat exchanger tubes 114*a* through 114*s* extend between the two tube walls 120*a* and 120*b* of the two plenums 112*a* and 112*b*, similar to those in the first embodiment heat exchanger 10.

The heat exchanger embodiment 110 differs from the earlier discussed embodiment 10 in the configuration of the flow restrictors. In the embodiment of the heat exchanger 110 of FIGS. 4 through 6F, the flow restrictors include a plurality of nozzles that include conical nozzles, respectively nozzles 124*a* through 124*s*, disposed between the corresponding tubes 114*a* through 114*s* and the tube wall 120*a*. Each of the nozzles 124*a* through 124*s* has a minor diameter 126 equal to the diameter of the corresponding tube 114*a* through 114*s* to which it is attached, such as shown in FIGS. 6A through 6F. However, the major diameter of the nozzles 124*a* through 124*s* varies depending upon the required flow restriction to substantially equalize or equalize the flow through each of the tubes 114*a* through 114*s*.

FIGS. 6A through 6G provide a series of cross-sectional views to illustrate examples of the different major diameters and corresponding conical angles of the nozzles 124*a* through 124*s*, relative to each other. FIG. 6A illustrates the very narrow conical nozzle configuration 124*j* that would be installed between the tube wall 120*a* and the central heat exchanger tube 114*j*. This configuration is analogous to the orifice 24*j* of FIG. 3A. As this tube 114*j* allows nearly the maximum flow due to its location at the transfer pipe 122*a* and the lack of any significant radial flow vector at this location, the conical shape of the nozzle 124*j* is quite narrow, and is very nearly cylindrical, for example. FIG. 6B provides a cross-sectional view of the widest major diameter conical nozzle 124*i* or 124*k* that would be installed with the corresponding tubes 114*i* and 114*k* immediately adjacent to the inlet of the transfer pipe 122*a*. This relatively wide conical shape is analogous to the largest orifices 24*i* and 24*k*, as shown in FIG. 3B. FIG. 6C illustrates a conical nozzle 124*g* or 124*m* having a slightly smaller major diameter, analogous to the orifice 24*g* or 24*m* of FIG. 3C. FIG. 6D illustrates an intermediate conical nozzle 124*e* or 124*o*, analogous to the intermediate orifices 24*e*, 24*o* of FIG. 3D. FIG. 6E illustrates an even narrower conical nozzle 124*c*, 124*q* analogous to the orifices 24*c* and 24*q* of FIG. 3E. Finally, FIG. 6F illustrates a cross-sectional view in which the nozzle 124*a* or 124*s* has no or substantially no conical taper whatsoever, i.e., the major diameter where it joins the tube wall 120*a* is the same or substantially the same as the internal diameter of the tube 114*a*, 114*s*. This is analogous to the smallest orifice 24*a* or 24*s* provided for the pipes 14*a* and 14*s* as shown in FIG. 3F of the drawings.

Figure 7:
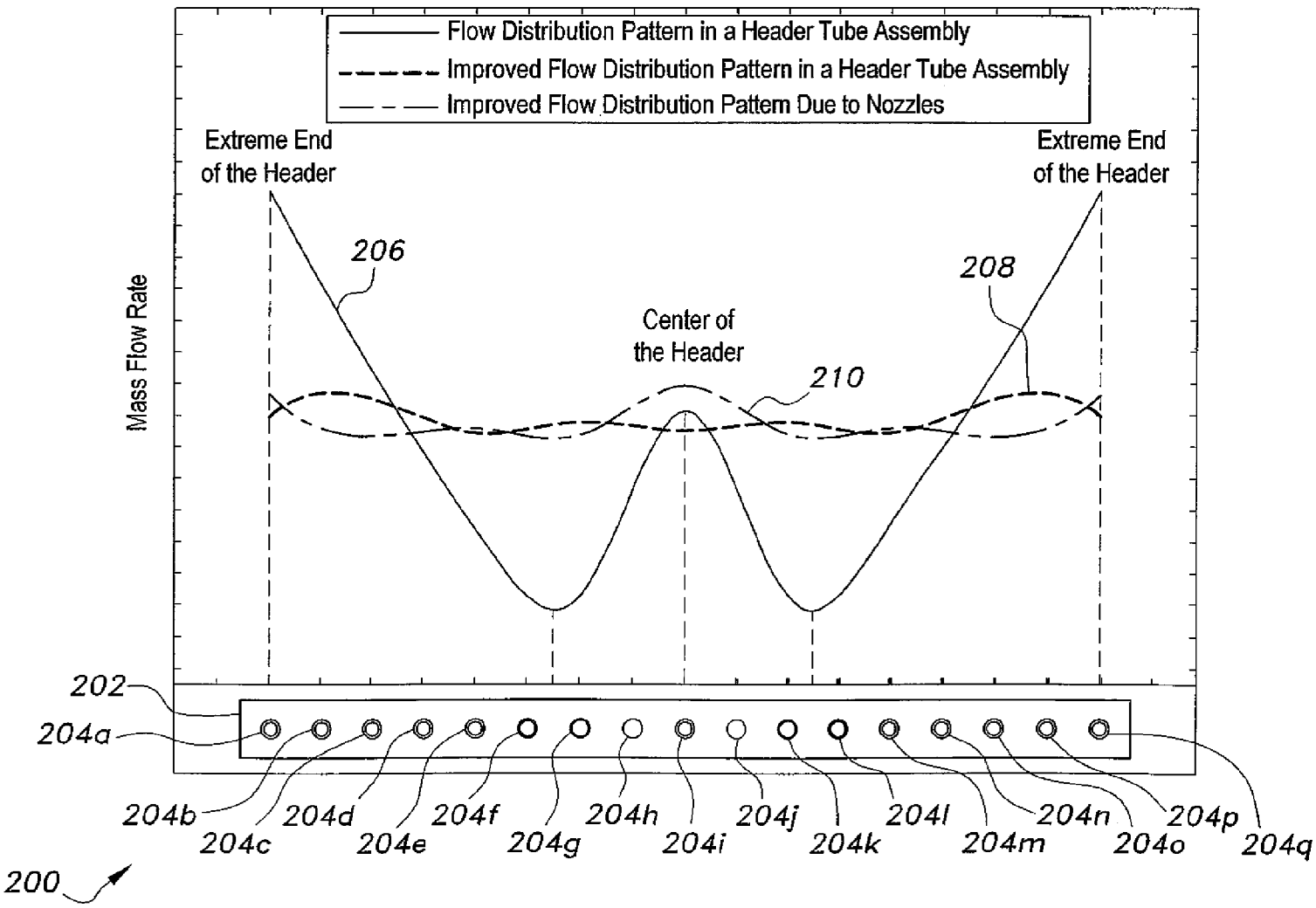
FIG. 7 is a graph illustrating the uncorrected flow through a heat exchanger and the corrected flows respectively through the heat exchanger for the first and the second embodiments of the heat exchanger flow balancing system according to the present invention.

Referring to FIG. 7, tests have been performed using an experimental prototype, to determine the equalization of flow provided by the different diameter orifices or conical nozzles installed in embodiments of heat exchangers of a heat exchanger flow balancing system. FIG. 7 provides a graph 200 illustrating the results of this testing. The lower portion of the graph 200 includes a representation of a tube wall 202 having a plurality of different diameter flow restrictions 204*a* through 204*q* installed therewith. This presentation has two fewer tubes and restrictors than the embodiments of FIGS. 1 through 6F for clarity in FIG. 7, but the principle of flow balancing remains substantially the same. The flow restrictions may include the orifices of the embodiment of the heat exchanger 10 of FIGS. 1 through 3F, or the conical nozzles of the embodiment of the heat exchanger 110 of FIGS. 4 through 6F, for example.

The graph 200 represents testing performed upon a plenum (or header) wherein the transfer pipe (e.g., inlet pipe) is installed at the center of the elongate header or plenum, with the central orifice 204*i* positioned at the center of the header. The legend at the top of the graph 200 indicates that the solid black line 206 represents a standard flow pattern in a conventional header tube (or plenum and tube) assembly, without varying the inlet orifices of the tubes. It can be seen that the solid line 206 on the graph 200 reaches maximum flow rates at the extreme ends of the plenum or header, through the end tubes and orifices 204*a* and 204*q*. Minimal flow rates are achieved through the orifices 204*f*, 204*g*, 204*k*, and 204*l* to each side of the central transfer pipe at the center of the header or plenum, with the difference in flow rates being on the order of about five times less through the unmodified orifices 204*f*, 204*g*, 204*k*, and 204*l* in comparison to the unmodified orifices 204*a* and 204*q* at the extreme ends of the header or plenum, for example.

Results following installation of flow restriction orifices as in the embodiment of FIGS. 1 through 3F are shown by the uniformly dashed line 208 on the graph 200. It will be seen that placement of restrictor orifices, as described above, results in a considerable smoothing out of the flow curve, thus showing a relatively significant gain in equalizing or substantially equalizing the flow rates through all of the heat exchanger tubes. The difference in flow rates as shown by the dashed line 208 is only about fifteen percent, approximately, for example.

In the graph 200, the alternating long and short dashed line 210 represents the flow rates following installation of a series of conical restrictor nozzles, as described above in the embodiment of FIGS. 4 through 6F. Once again, the flow rates have been very nearly equalized or substantially equalized throughout all of the heat exchanger tubes, with the difference in maximum and minimum flow rates being only approximately fifteen percent, for example. Further adjustment of orifice or nozzle diameters may result in further equalization of flow in the tubes, but the results achieved from the test, as illustrated in the graph 200, indicate a relative sufficiency for practical purposes.

Numerous variations on the above-described heat exchanger configurations may be provided while still making use of either (or perhaps both) of the flow modification orifices or nozzles described further above. For example, the heat exchanger may have its transfer pipe (inlet or outlet) located at or close to one end of the plenum or header. In such a case, the mirror image installation of restrictors to each side of the transfer pipe typically may not be applicable, but the restrictors may decrease in diameter toward the most distant heat exchanger tube. Moreover, while the restrictors have been described as being installed at the inlet plenum ends of the tubes, the term "transfer pipe" is intended to include either an inlet pipe or an outlet pipe, and should therefore not be construed in a limiting sense. In certain circumstances, the restrictors (orifices or nozzles) may be installed at the outlet ends of the heat exchanger tubes, or some combination of inlet end and outlet end installations may be carried out, for example. In any event, the installation of such orifice or nozzle restrictors in embodiments of heat exchangers, in a manner similar to the described embodiments, can significantly improve the average flow through such heat exchangers, and can thereby significantly increase heat exchanger efficiencies.

It is to be understood that the present invention is not limited to the embodiments described above, but encompasses any and all embodiments within the scope of the following claims.

We claim:

1. A heat exchanger flow balancing system, comprising:

a first plenum having a first end, a second end opposite the first end, and a tube wall, wherein the first plenum extends between the first and second ends thereof along a first direction;

a first transfer pipe communicating with the first plenum, wherein the first transfer pipe extends along a second direction orthogonal to the first direction;

a second plenum spaced apart from the first plenum, the second plenum having a first end, a second end opposite the first end, and a tube wall, wherein the second plenum extends between the first and second ends thereof along the first direction;

a second transfer pipe communicating with the second plenum, wherein the second transfer pipe extends along the second direction;

a plurality of tubes extending between the tube wall of the first plenum and the tube wall of the second plenum, each of the tubes being of equal diameter to one another, the first plenum communicating with the second plenum by the plurality of tubes extending therebetween, wherein each said tube extends along a third direction orthogonal to the first and second directions; and a flow restriction disposed at a juncture of each of the tubes with the first plenum, where smallest diameter restrictions are located at a juncture nearest the first transfer pipe and at each juncture farthest from the first transfer pipe, where diameters of the flow restrictions of the remaining junctures of the remaining transfer pipes decreases from the restriction at the juncture nearest first transfer pipe to each of the junctures farthest from the first transfer pipe.

2. The heat exchanger flow balancing system according to claim 1, wherein the flow restrictions comprise restrictor orifices formed in the tube wall.

3. The heat exchanger flow balancing system according to claim 1, wherein the flow restrictions comprise conical nozzles disposed between the tube wall and the tubes.

4. The heat exchanger flow balancing system according to claim 3, wherein each of the conical nozzles has a minor diameter equal to the tube diameter and a major diameter at the juncture of each corresponding tube with the first plenum.

5. The heat exchanger flow balancing system according to claim 1, wherein at least the first transfer pipe is disposed medially with the first plenum.

6. The heat exchanger flow balancing system according to claim 1, wherein the first plenum is an inlet plenum.

7. The heat exchanger flow balancing system according to claim 1, wherein the first plenum is an outlet plenum.

8. A heat exchanger flow balancing system, comprising:

a first plenum having a first end, a second end opposite the first end, and a tube wall, wherein the first plenum extends between the first and second ends thereof along a first direction;

a first transfer pipe communicating with the first plenum, wherein the first transfer pipe extends along a second direction orthogonal to the first direction;

a second plenum spaced apart from the first plenum, the second plenum having a first end, a second end opposite the first end, and a tube wall, wherein the second plenum extends between the first and second ends thereof along the first direction;

a second transfer pipe communicating with the second plenum, wherein the second transfer pipe extends along the second direction;

a plurality of tubes extending between the tube wall of the first plenum and the tube wall of the second plenum, each of the tubes being of equal diameter to one another, the first plenum communicating with the second plenum by the plurality of tubes extending therebetween, wherein each said tube extends along a third direction orthogonal to the first and second directions; and a restrictor orifice disposed in the tube wall at a juncture of each of the tubes with the first plenum, where smallest diameter restrictor orifices are located at a juncture nearest the first transfer pipe and at each juncture farthest from the first transfer pipe, where diameters of the restrictor orifices of the remaining junctures of the remaining transfer pipes decreases from the restrictor orifice at the juncture nearest first transfer pipe to each of the junctures farthest from the first transfer pipe.

9. The heat exchanger flow balancing system according to claim 8, wherein at least the first transfer pipe is disposed medially with the first plenum.

10. The heat exchanger flow balancing system according to claim 8, wherein the first plenum is an inlet plenum.

11. The heat exchanger flow balancing system according to claim 8, wherein the first plenum is an outlet plenum.

12. A heat exchanger flow balancing system, comprising:

a first plenum having a first end and a second end opposite the first end, wherein the first plenum extends between the first and second ends thereof along a first direction;

a first transfer pipe communicating with the first plenum, wherein the first transfer pipe extends along a second direction orthogonal to the first direction;

a second plenum spaced apart from the first plenum, the second plenum having a first end and a second end opposite the first end, wherein the second plenum extends between the first and second ends thereof along the first direction;

a second transfer pipe communicating with the second plenum, wherein the second transfer pipe extends along the second direction;

a plurality of tubes extending between the first plenum and the second plenum, each of the tubes being of equal diameter to one another, the first plenum communicating with the second plenum by the plurality of tubes extending therebetween, wherein each said tube extends along a third direction orthogonal to the first and second directions; and a nozzle disposed at a juncture of each of the tubes with the first plenum, where smallest diameter nozzles are located at a juncture nearest the first transfer pipe and at each juncture farthest from the first transfer pipe, where diameters of the nozzles of the remaining junctures of the remaining transfer pipes decreases from the nozzle at the juncture nearest first transfer pipe to each of the junctures farthest from the first transfer pipe.

13. The heat exchanger flow balancing system according to claim 12, wherein the nozzles comprise conical nozzles having a minor diameter equal to the tube diameter and a major diameter at the juncture of each corresponding tube with the first plenum.

14. The heat exchanger flow balancing system according to claim 12, wherein at least the first transfer pipe is disposed medially with the first plenum.

15. The heat exchanger flow balancing system according to claim 12, wherein the first plenum is an inlet plenum.

16. The heat exchanger flow balancing system according to claim 12, wherein the first plenum is an outlet plenum.

* * * * *